United States Patent [19]

Darnfors

[11] 4,161,794

[45] Jul. 24, 1979

[54] INFLATABLE CUSHION

[75] Inventor: Kristina E. Darnfors, Askim, Sweden

[73] Assignee: Bengt Petersson New Products Investment AB, Göteborg, Sweden

[21] Appl. No.: 693,180

[22] Filed: Jun. 7, 1976

[30] Foreign Application Priority Data

Jun. 9, 1975 [SE] Sweden ..... 7506543

[51] Int. Cl.[2] ..... A47G 9/00; A47C 27/10

[52] U.S. Cl. ..... 5/441; 5/455

[58] Field of Search ..... 5/337, 338, 341, 365, 5/368, 339; 297/391, 394, 397; 46/87, 88, 89

[56] References Cited

U.S. PATENT DOCUMENTS

| | | | |
|---|---|---|---|
| 1,343,357 | 6/1920 | Eggers | 5/365 |
| 1,810,556 | 6/1931 | Fenton | 5/338 |
| 3,235,892 | 2/1966 | Emery | 5/368 |
| 3,312,987 | 4/1967 | Emery | 5/337 |

FOREIGN PATENT DOCUMENTS

| | | | |
|---|---|---|---|
| 548990 | 11/1942 | United Kingdom | 5/337 |

*Primary Examiner*—Kenneth J. Dorner

[57] ABSTRACT

Inflatable resting cushion, the supporting part of which is made of two sheets of a flexible material, which sheets are joined together along defining lines. Said lines define the shape of the cushion and divide the same into two inflatable air compartments between which the air communication is kept interrupted. The one of said defining lines, which defines the limits of separation of the two inflatable compartments from each other, exhibits a curved shape.

2 Claims, 11 Drawing Figures

INFLATABLE CUSHION

Figure 1:
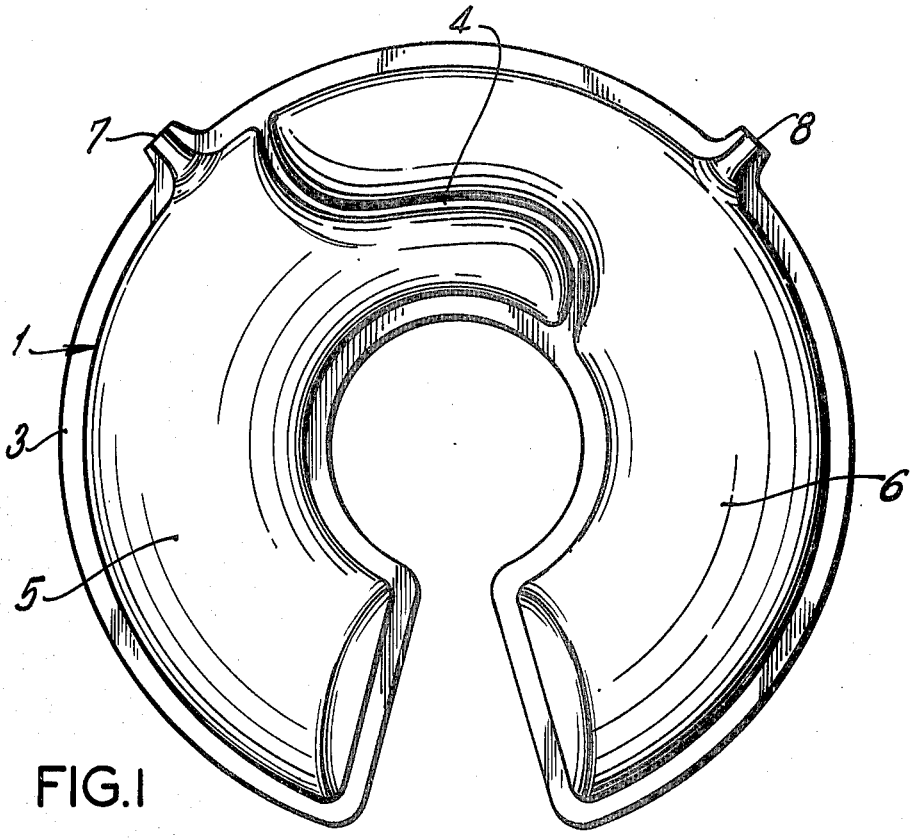

The present invention relates to an inflatable resting cushion the supporting part of which is made of two sheets of a flexible material, which sheets are joined together along defining lines, which defines the shape of the cushion and divides the same into two inflatable air compartments between which the air communication is kept interrupted.

Inflatable cushions—especially such ones, which exhibit a great overall surface extension relative to their volume—as a rule have to be divided up into two or more air compartments, one separated from the other in order to offer its user a comfortable softness. This is due to the fact that such cushions usually are not inflated until the limit of deformation of the material is reached, in order to avoid an uncomfortable stiffness of the surface of the cushion. However, this involves the drawback that when a portion of the cushion is compressed, an expansion of the volume of the other portions of the cushion takes place because of the resiliency of the material, a certain compression of the enclosed air also taking place, which brings in its train an undesired yielding property of the cushion. Thus, by the division into two or more air compartments as mentioned above, this drawback is eliminated.

However, this division in its turn brings with it a drawback in connection with the most common type of inflatable cushions, viz. such ones, which for example comprise two material sheets attached to each other by means of seams. This drawback involves the fact that the cushion does not get an overall uniform thickness in all parts as the partition required between the air compartments is reduced to a thickness substantially equal to the combined thickness of the two sheets.

In connection with resting cushions of the prior art of the type mentioned, said partition is designed in such a way that the air compartments obtained will be of completely symmetric and regular shape, the defining line formed being made as a straight line. But in addition to the above mentioned drawback a considerable further drawback arises, viz. the so called hinge effect, i.e. one does not get any stiffness whatsoever against folding round the axis formed by the straight defining line.

The ability to maintain the main shape of the cushion is caused by the extension of the two material sheets by means of the enclosed air volume. However, this condition does not exist on the actual defining line, where the material sheets are completely joined together. If this defining line is completely straight it can thus form an axis around which the two separated air compartments easily will be folded even unintentionally.

The above mentioned drawbacks are eliminated in connection with the resting cushion according to the present invention by making the defining line, which defines the limits of separation of the two inflatable compartments from each other, exhibiting a curved shape.

Hereby an imagined folding axis cannot coincide with the curve shaped defining line, but extends through at least one part of the two compartments, which has a stiffening effect and prevents an unintended folding of the cushion.

Figure 2:
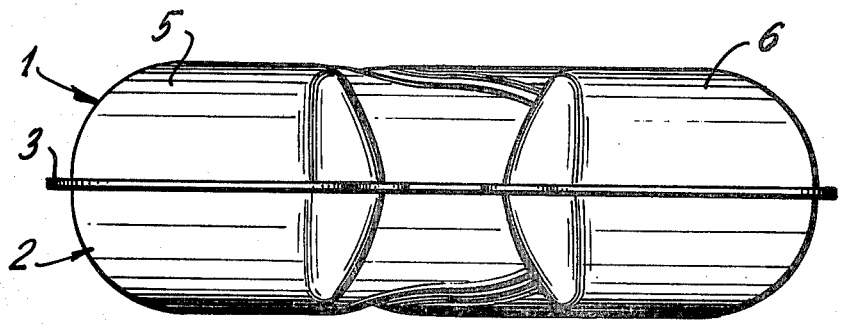
Figure 3:
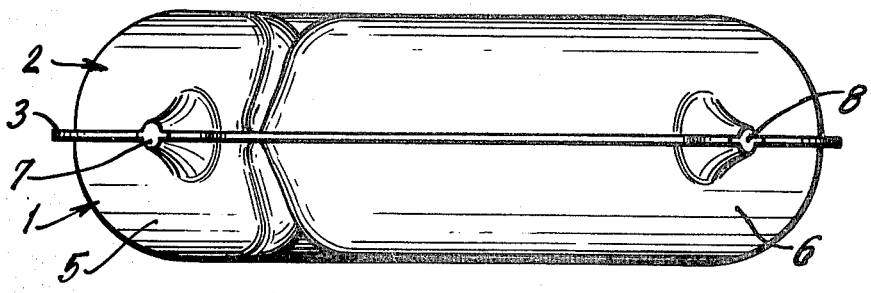
Figure 4:
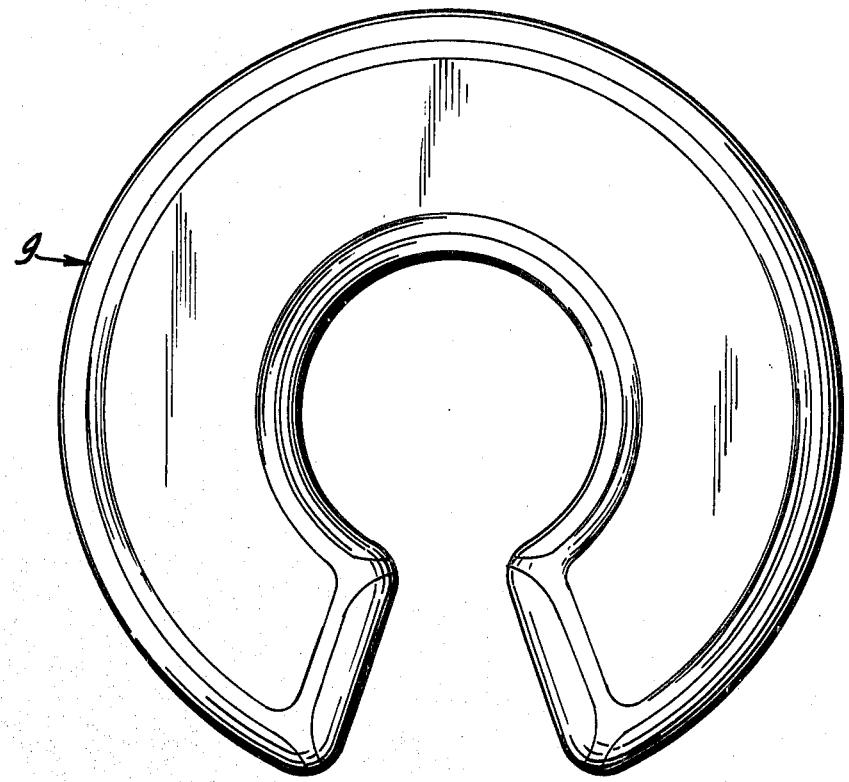
Figure 5:
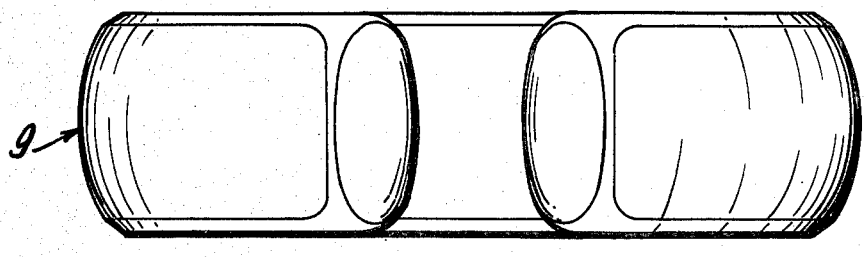
Figure 6:
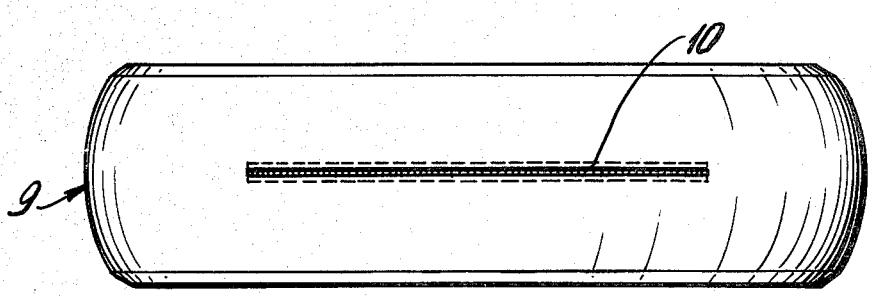
Figure 7:
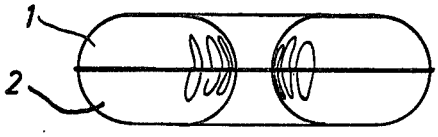
Figure 8:
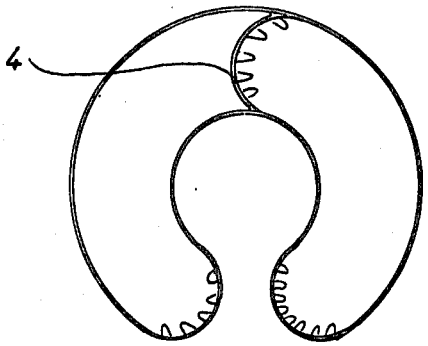
Figure 9:
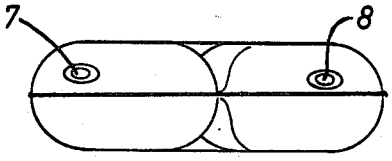
Figure 11:
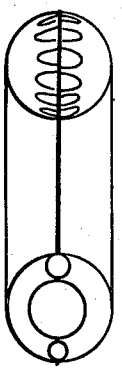
Figure 10:
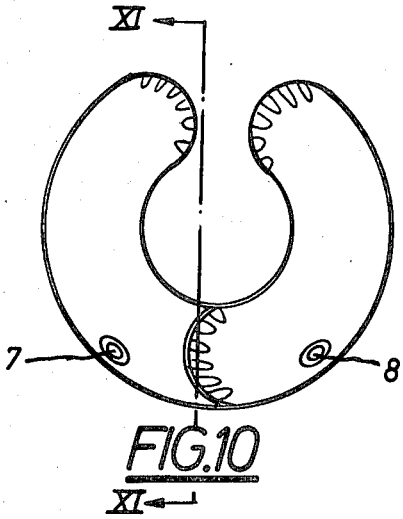

The invention will now be described in detail with reference to the accompanying drawings, in which FIGS. 1, 2 and 3 illustrate the resting cusion according to the invention in a first embodiment in a plan view and two opposed side elevational views respectively. FIGS. 4, 5 and 6 illustrate an example of a cover suitable for the resting cushion according to the invention in views corresponding to the FIGS. 1, 2 and 3. FIGS. 7, 8, 9 and 10 show the resting cushion from different angles in a second embodiment, while FIG. 11 shows the resting cushion in a cross sectional view along the line XI—XI in FIG. 10.

As is evident from the embodiment shown in FIGS. 1, 2 and 3 the resting cushion according to the invention is composed of two sheets 1, 2 which are joined together by way of example by welding along the defining lines 3, 4 defining the shape of the cushion and moreover dividing up the same into two inflatable compartments to be filled with air. The defining line 4, which provides said division, according to the present invention extends in a curve, which as is best evident from FIG. 3, gives all portions of the cushion substantially the same thickness, and thereby the cushion with respect to its entire surface of use is given substantially the same characteristics as regards yielding properties and other comfort for the user.

Thus, the two air compartments 5, 6 are not in communication with each other, but are individually inflated each one by means of its valve 7, 8.

By way of example the resting cushion can be designed with an inner supporting part of a simple flexible material, for example a plastic foil, and with a covering part 9 of a material, which is comfortable to the user, for example a textile fabric. In said connection the inner supporting part is introduced into the cover before being inflated, whereafter said cover is closed by a zip fastener 10.

In the second embodiment of the resting cushion according to the invention illustrated in FIGS. 7–11, the separating defining line 4 has been given a simple curvature and substantially forms the shape of a U. This shape has turned out to be very suitable in a practical embodiment with respect to the shaping characteristics of the plastic materials in most common use. In addition to a deviation as to the thickness of different portions of the cushion a very good stiffening against folding action of the two air compartments is obtained because of the overlapping portions of said compartments, something which has not been the case with earlier solutions of the prior art.

In a very advantageous embodiment one has omitted the covering part and substituted the same by a coating directly applied to the supporting part surrounding the air compartments. An example of such material is so called velour finished plastic material, either one sheet 1 or both the sheets 1, 2 being made of this textile material or similar material.

The cushion according to the present invention is very useful for travellers in aeroplanes, trains, cars, etc, where the seats do normally not offer a comfort sufficient for resting and sleeping. When in use the cushion filled with air will be placed like a collar around the traveller's neck, thereby offering the user a very comfortable support in most directions. When not in use the cushion will take a very small place deflated and folded together. Thus the cushion can be easily brought in the traveller's bag or similar. Alternatively it can be included in the normal equipment of the aeroplane, car, etc.

I claim:

1. A substantially annular inflatable resting cushion having two ends and a middle section and comprising two sheets of a flexible material joined together along defining border lines which define the shape of the cushion, said cushion being divided into two separate inflatable compartments by a curved defining line in the middle section, each of said compartments having a reduced portion in overlapping relationship with the other of said compartments in said middle portion such that a radius passing through the middle section will pass through the reduced portion of each of the compartments.

2. Inflatable resting cushion according to claim 1, wherein said curve shaped defining line substantially forms an S-shape.

* * * * *